US005738522A

United States Patent [19]

Sussholz et al.

[11] Patent Number: 5,738,522

[45] Date of Patent: Apr. 14, 1998

[54] APPARATUS AND METHODS FOR ACCURATELY SENSING LOCATIONS ON A SURFACE

[75] Inventors: Adi Sussholz, Tel Aviv; Yoram Goren, Petach Tikva, both of Israel

[73] Assignee: N.C.C. Network Communications and Computer Systems, Tel Aviv, Israel

[21] Appl. No.: 437,615

[22] Filed: May 8, 1995

[51] Int. Cl.[6] ..... F41G 3/26

[52] U.S. Cl. ..... 434/22; 434/20; 434/307 R; 463/5; 353/30; 348/25

[58] Field of Search ..... 434/11, 16–24, 434/27, 307 R, 308, 365; 348/25, 28, 61, 121; 353/30, 31; 463/5, 34

[56] References Cited

U.S. PATENT DOCUMENTS

| | | | |
|---|---|---|---|
| 3,964,178 | 6/1976 | Marshall et al. | 434/22 X |
| 3,996,674 | 12/1976 | Pardes et al. | 434/22 |
| 4,137,651 | 2/1979 | Pardes et al. | 434/20 |
| 4,223,454 | 9/1980 | Mohon et al. | 434/22 X |
| 4,336,018 | 6/1982 | Marshall et al. | 434/22 |
| 4,657,511 | 4/1987 | Allard et al. | 434/20 |
| 4,680,012 | 7/1987 | Morley et al. | 434/20 X |
| 5,194,008 | 3/1993 | Mohon et al. | 434/22 |
| 5,215,463 | 6/1993 | Marshal . | |
| 5,242,306 | 9/1993 | Fisher | 434/44 |
| 5,366,229 | 11/1994 | Suzuki | 434/20 X |

OTHER PUBLICATIONS

Don Lake, "Feature Size and Position Accuracy: Is That Subpixel Accuracy –or Not?" Advanced Imaging, Jan., 1993, pp. 44, 45, 46, 47.

*Primary Examiner*—Joe Cheng

*Attorney, Agent, or Firm*—Abelman, Frayne & Schwab

[57] ABSTRACT

Apparatus for merging a video image sequence of a dynamic phenomenon occurring on a natural background into a high resolution background image, the apparatus including a background remover operative to remove the natural background from the video image sequence, and a phenomenon-background merger operative to merge the video image sequence of the dynamic phenomenon, with natural background removed, into the high resolution background image.

7 Claims, 11 Drawing Sheets

APPARATUS AND METHODS FOR ACCURATELY SENSING LOCATIONS ON A SURFACE

FIELD OF THE INVENTION

The present invention relates to small arms simulators and methods and apparatus useful therefor.

BACKGROUND OF THE INVENTION

Realistic and easily operable small arms simulators are extremely important for small arms training. Such simulators may be used, for example, for entertainment or for military training applications.

U.S. Pat. No. 5,215,463 to Marshall et al describes an interactive scenario based simulator for training a weapons team in which an infrared source is mounted on a model weapon.

"Feature size and positional accuracy: Is that Subpixel Accuracy—or Not?" discusses the problem of minimum feature size in electronic imaging with solid state cameras.

The disclosures of all the above publications are incorporated herein by reference.

SUMMARY OF THE INVENTION

The present invention seeks to provide improved apparatus and methods for simulating use of small arms.

There is thus provided in accordance with a preferred embodiment of the present invention apparatus for merging a video image sequence of a dynamic phenomenon occurring on a natural background into a high resolution background image, the apparatus including a background remover operative to remove the natural background from the video image sequence, and a phenomenon-background merger operative to merge the video image sequence of the dynamic phenomenon, with natural background removed, into the high resolution background image.

There is also provided in accordance with another preferred embodiment of the present invention apparatus for merging a video image sequence of a dynamic phenomenon occurring on a natural background into a high resolution background image, the apparatus including a high resolution background image processor operative to store a representation of the structure of the high resolution background image, a background remover operative to remove the natural background from the video image sequence, and an occulting merger operative to merge the video image sequence, with natural background removed, into the high resolution background image and to occult the contents of the video image sequence to take into account the structure of the high resolution background image.

Further in accordance with a preferred embodiment of the present invention the dynamic phenomenon blurs into the natural background.

Still further in accordance with a preferred embodiment of the present invention the dynamic phenomenon includes smoke.

Additionally in accordance with a preferred embodiment of the present invention the dynamic phenomenon includes dust.

Moreover in accordance with a preferred embodiment of the present invention the dynamic phenomenon includes fire.

Further in accordance with a preferred embodiment of the present invention the apparatus also includes a fader operative to gradually terminate the phenomenon.

There is also provided in accordance with another preferred embodiment of the present invention apparatus for generating a scenario from a plurality of video image sequences, the apparatus including a bank of video image sequences each including at least one video image, and a real time merger operative to merge at least one selected video image sequence into a background image in real time, thereby to generate the scenario.

Further in accordance with a preferred embodiment of the present invention the apparatus includes a video image sequence cyclicizer operative to cyclicize a video image sequence such that its final images are similar to its initial images.

Still further in accordance with a preferred embodiment of the present invention the apparatus includes a scenario brancher operative to receive external input and to branch the scenario in accordance with the external input.

Additionally in accordance with a preferred embodiment of the present invention the structure of the high resolution background image includes 2.5 dimensional structure of the background.

Further in accordance with a preferred embodiment of the present invention the at least one video image includes a plurality of video images.

There is also provided in accordance with another preferred embodiment of the present invention apparatus for sensing an indication of a location on a surface at a first resolution using a video camera with a second resolution which is less than the first resolution, the apparatus including a large vicinity generator operative to provide an indication of a vicinity of the location which is large in comparison to the second resolution, and a large vicinity processor operative to process the indication of the vicinity in order to find a central location therewithin at a resolution which is at least equal to the first resolution.

Further in accordance with a preferred embodiment of the present invention the apparatus includes a video camera operative to sense the vicinity.

Still further in accordance with a preferred embodiment of the present invention the apparatus includes a laser source operative to provide a laser beam whose cross section is large in comparison to the second resolution.

Additionally in accordance with a preferred embodiment of the present invention the laser source is actuated by a model weapon.

There is also provided in accordance with another preferred embodiment of the present invention an aiming localization system operative to localize an aiming point of at least one simulated weapon, the system including a continuous sample generator operative to continuously sample the aiming point of the simulated weapon, and an aiming point computer operative to compute the aiming point of the simulated weapon at a selected time by processing the output of the continuous sample generating apparatus.

Further in accordance with a preferred embodiment of the present invention the selected time includes the time at which a trigger of the simulated weapon is pulled.

Still further in accordance with a preferred embodiment of the present invention wherein the continuous sample generator includes a time division multiplexing continuous sample generator operative to continuously sample the aiming points of a plurality of simulated weapons.

Additionally in accordance with a preferred embodiment of the present invention the apparatus also includes a continuously operative sensor operative to continuously sense user input and to actuate the real time merger responsive to the sensed user input.

There is also provided in accordance with another preferred embodiment of the present invention a method for generating a high resolution scenario having more than two dimensions, the method including providing a two-dimensional image of a scenario including a first plurality of elements, and receiving from a user a categorization of each of the first plurality of elements into one of a second plurality of positions along a third dimension.

Further in accordance with a preferred embodiment of the present invention the positions along the third dimension are ordered and wherein the distances between the positions are not defined.

Still further in accordance with a preferred embodiment of the present invention the method includes merging an image sequence including at least one image into the scenario including defining a first location of the image in the sequence by specifying the position of the image, when in the first location, along all three dimensions.

Additionally in accordance with a preferred embodiment of the present invention the method includes defining at least a second location of the image in the sequence by specifying the position of the image, when in the second location, along all three dimensions, and merging the image sequence into the scenario and providing an occulting relationship between the image sequence and the plurality of elements as defined by the positions of the image sequence and of the plurality of elements along the third dimension, thereby to generate an image which appears to move from the first location to the second location.

There is also provided in accordance with another preferred embodiment of the present invention a method for merging a video image sequence of a dynamic phenomenon occurring on a natural background into a high resolution background image, the method including removing the natural background from the video image sequence, and merging the video image sequence of the dynamic phenomenon, with natural background removed, into the high resolution background image.

There is also provided in accordance with another preferred embodiment of the present invention a method for merging a video image sequence of a dynamic phenomenon occurring on a natural background into a high resolution background image, the method including storing a representation of the structure of the high resolution background image, removing the natural background from the video image sequence, and merging the video image sequence, with natural background removed, into the high resolution background image and occulting the contents of the video image sequence to take into account the structure of the high resolution background image.

There is also provided in accordance with another preferred embodiment of the present invention a method for generating a scenario from a plurality of video image sequences, the method including providing a bank of video image sequences each including at least one video image, and merging at least one selected video image sequence into a background image in real time, thereby to generate the scenario.

There is also provided in accordance with another preferred embodiment of the present invention a method for sensing an indication of a location on a surface at a first resolution using a video camera with a second resolution which is less than the first resolution, the method including providing an indication of a vicinity of the location which is large in comparison to the second resolution, and processing the indication of the vicinity in order to find a central location therewithin at a resolution which is at least equal to the first resolution.

There is also provided in accordance with another preferred embodiment of the present invention an aiming localization method operative to localize an aiming point of at least one simulated weapon, the method including continuously sampling the aiming point of the simulated weapon, and computing the aiming point of the simulated weapon at a selected time by processing the output of the continuously sampling.

There is also provided in accordance with another preferred embodiment of the present invention apparatus for generating a high resolution scenario having more than two dimensions, the apparatus including an image memory storing a two-dimensional image of a scenario including a first plurality of elements, and a 2.5 dimensional user input receiver operative to receive from a user a categorization of each of the first plurality of elements into one of a second plurality of positions along a third dimension.

There is also provided in accordance with another preferred embodiment of the present invention a weapon simulation system including a plurality of simulated weapons each operative to generate simulated hits within a scenario, a simulated hit detector operative to detect locations of the simulated hits, and a weapon synchronization unit operative to synchronize the plurality of simulated weapons such that at most one weapon is operative to generate a hit at each individual time and to provide weapon identification information to the hit detector identifying the individual weapon which is operative to generate a hit at each individual time.

There is also provided in accordance with another preferred embodiment of the present invention a weapon simulation method including providing a plurality of simulated weapons each operative to generate simulated hits within a scenario, detecting locations of the simulated hits, synchronizing the plurality of simulated weapons such that at most one weapon is operative to generate a hit at each individual time, and providing weapon identification information to the hit detector identifying the individual weapon which is operative to generate a hit at each individual time.

BRIEF DESCRIPTION OF THE DRAWINGS

The present invention will be understood and appreciated from the following detailed description, taken in conjunction with the drawings in which.

DETAILED DESCRIPTION OF A PREFERRED EMBODIMENT

Figure 1:
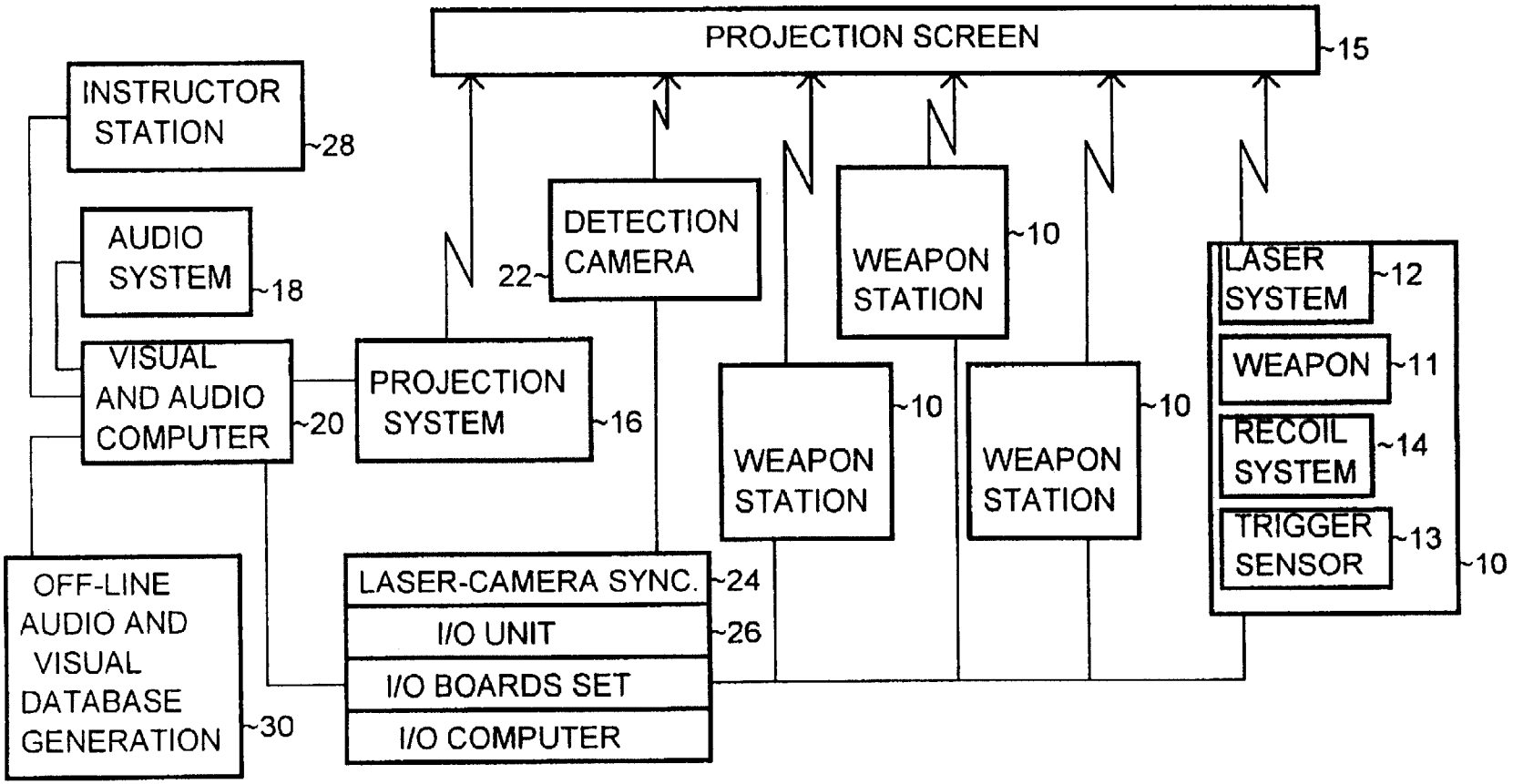
FIG. 1 is a simplified block diagram of a small arms simulator constructed and operative in accordance with a preferred embodiment of the present invention.

Reference is made to FIG. 1 which is a simplified block diagram of a small arms simulator constructed and operative in accordance with a preferred embodiment of the present invention. The small arms simulator of FIG. 1 includes a plurality of weapon stations 10, four of which are illustrated, although any suitable number of weapon stations may be provided. For example, 12 weapon stations may be provided, for example by providing three of each of the components of FIG. 1 apart from the instructor station.

Each weapon station 10 preferably includes a genuine weapon 11 on which is mounted a laser transmitting system 12, a trigger operation sensor 13, and, typically, a recoil simulator 14. Any suitable small arms may be employed as weapons such as, for example, pistols, rifles, shotguns, machine guns, and anti-tank missile launchers.

The laser transmitting system 12 may, for example, comprise a 8541020007 laser transmitter, commercially available from International Technologies (Laser) Ltd., Rishon-LeZion, Israel.

The weapon 11 is arranged such that the laser beam generated by the laser transmitting system 12 impinges upon a projection screen 15 such as a 12×16 foot screen, commercially available from Draper, Spiceland, Ind., USA.

A projection system 16 projects a high resolution video image sequence onto the screen. The video image sequence comprises a sequence of stills each of which preferably comprises a high resolution photograph or a merge of a plurality of high resolution photographs as is explained in more detail below. In place of or in addition to a photograph, each of the sequence of stills may comprise an artificial image.

Preferably, audio effects which are synchronized to the video image sequence are provided by an audio system 18. The projection system 16 and the audio system 18 are controlled by a visual and audio computer 20.

The projection screen 15 is photographed, preferably substantially continuously, i.e. at a high rate, by a detection camera 22 such as an IndyCam, commercially available from Silicon Graphics, Mountainview, Calif., USA, or any other conventional video camera which is capable of capturing the video image sequence and the laser spot transmitted by the weapon-mounted laser transmitter.

A typical rate of operation for the video camera is 60 Hz.

For example, the visual and audio computer 20 may comprise a Silicon Graphics Indy workstation, and the video camera 22 may comprise the Indycam video camera which is marketed in association with the Silicon Graphics Indy workstation.

A laser-camera synchronization unit 24 is operative to synchronize the operation of the laser transmitters 12 to the operation of the camera 22. Typically, time division multiplexing is employed to control the laser transmitters of the plurality of weapons and the multiplexing is coordinated with the rate of operation of the camera to ensure that the laser spots generated by the various weapons appear in different frames and are thus discriminated.

An I/O interface unit 26 is operative to provide an indication of each time a trigger is pulled, to the computer 20.

An instructor station 28 is operative to control operation of the entire system, such as initiating and terminating a training session. For example, the instructor station 28 may comprise the monitor, mouse and keyboard of the Indy workstation.

An off-line audio-visual image database generation unit 30, such as a Silicon Graphics Indy workstation equipped with a Matador Paint-and Animation tool, both commercially available from Parallax, London, Great Britain, is operative to generate and store high resolution background images, image sequences representing static and dynamic phenomena and sound effects.

Figure 2:
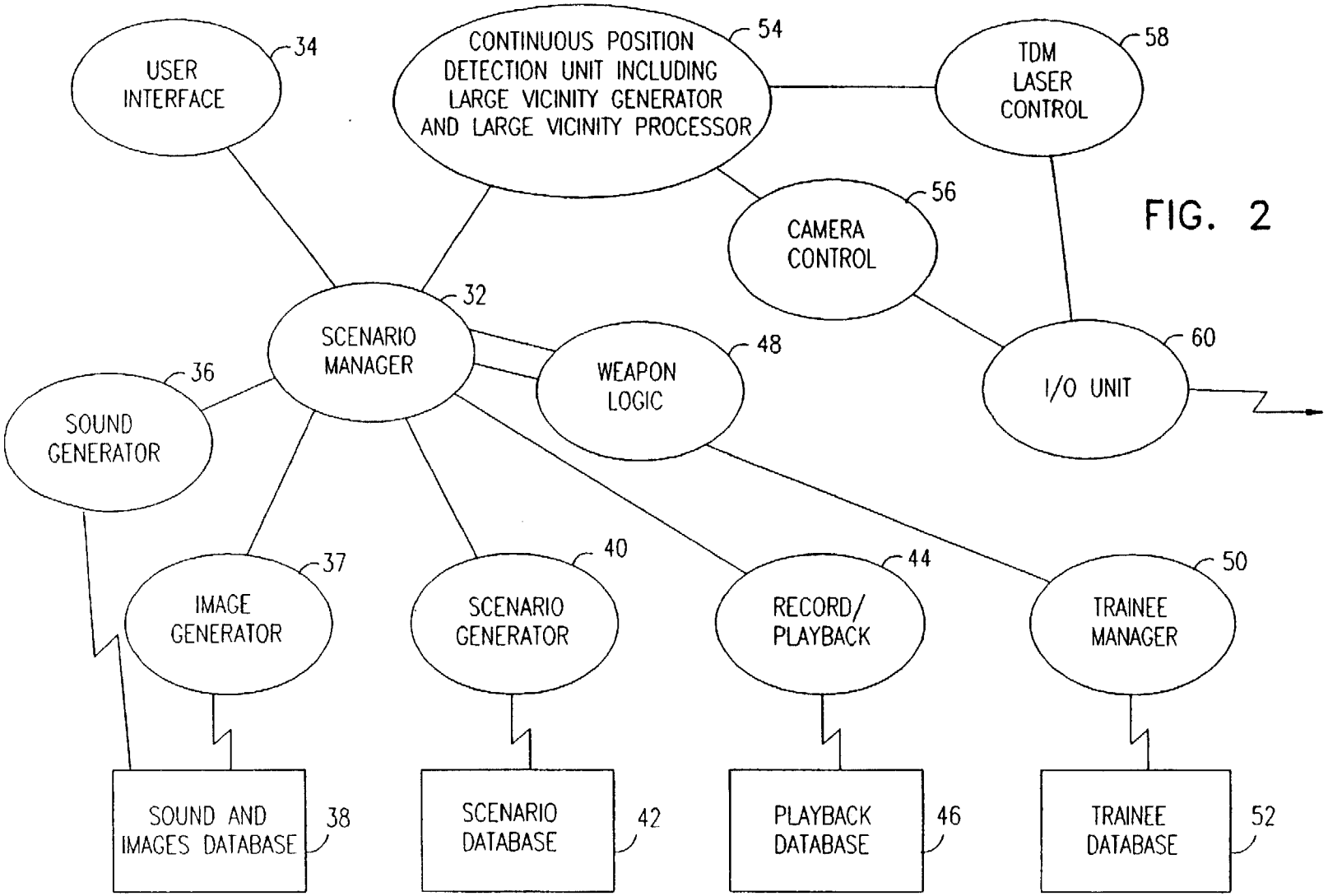
FIG. 2 is a simplified functional block diagram of the visual and audio computer 20 of FIG. 1.

FIG. 2 is a simplified functional block diagram of the visual and audio computer 20 of FIG. 1. The visual and audio computer 20 preferably includes the following functional subsystems:

Scenario manager 32, coordinating all other subsystems;

User interface 34, receiving user inputs such as definitions of scenarios and trainee particulars, typically via a mouse or keyboard;

sound generator 36 operative to generate sound tracks for scenarios;

image generator 37, operative to create displays of frame by frame displays of the scenario according to user-specified definitions and trainees' interaction, by accessing the scenario database;

sound and image database 38 storing sound and visual effects used to generate scenarios;

scenario generator 40 operative to generate scenarios using sound and visual effects from database 38 by controlling image generator 37;

scenario database 42 storing predetermined or user-determined scenarios including relationships between images stored in database 38;

record/playback unit 44 for recording, storing and replaying training sessions;

a playback database 46 for storing training sessions for replay by unit 44; and weapon logic 48 operative to simulate the operational characteristics of a weapon, for example, by indicating that a magazine is empty after the user has "shot" the number of bullets which the magazine of a particular weapon holds;

trainee manager 50, operative to handle trainee's history records and training results;

trainee database 52 operative to store the trainee history records and training results;

continuous position detection module 54 operative to localize aiming points of weapons. Preferably, the continuous position detection module is continuously operative to sample the aiming point of the simulated weapon. The rate of sampling for each weapon preferably exceeds the Nyquist criterion regarding the bandwidth of human motion. The bandwidth of the motion of a human controlled weapon is typically between 4 Hz and 6 Hz and therefore, a suitable sampling rate is approximately 8 Hz to 12 Hz.

A particular advantage of continuous position detection is that the motion of the aiming point may be reconstructed retroactively and in particular, the location of the aiming point at the moment a trigger was pulled may be accurately reconstructed retroactively. In contrast, in conventional systems, position detection is only activated upon sensing that a trigger has been pulled which causes inevitable delay and necessitates hardware capable of carrying out very rapid position detection;

camera control unit 56 which synchronizes the camera which digitizes the image on the screen;

TDM (time division multiplexed) laser control 58, which synchronizes the laser transmitters mounted on the weapon stations 10 of FIG. 1, typically using conventional TDM methods. Preferably, only a single laser transmitter is actuated during each frame captured by detection camera 22 of FIG. 1, which allows hits to be easily associated with the weapon station which generated the hit. For example, a cyclic schedule is employed whereby each of 4 weapon stations 10 are actuated one after the other each for the duration of a single frame of detection camera 22 of FIG. 1. The continuous position detection module 54, using synchronization information provided by laser camera synchronization unit 24, discerns which weapon station 10 is associated with a detected hit in an individual frame of detection camera 22; and an I/O unit 60 which provides hardware interfaces between the various subsystems and in particular provides information from weapon sensors such as a trigger operation sensor, a magazine presence sensor, a safety switch position sensor.

Figure 3:
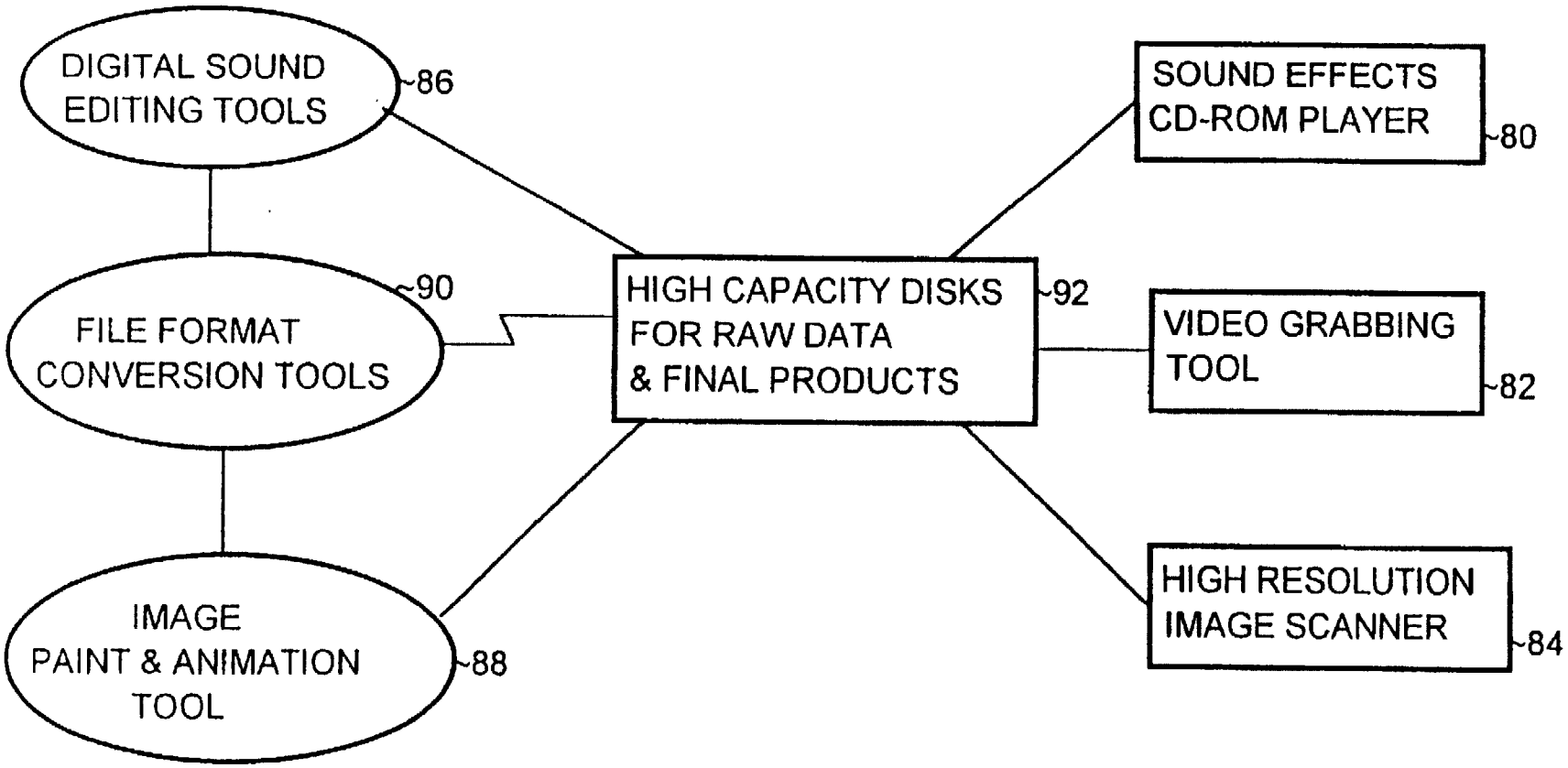
FIG. 3 is a simplified functional block diagram of the off-line audio and visual database generation unit 30 of FIG. 1.

FIG. 3 is a simplified functional block diagram of the off-line audio and visual database generation unit 30 of FIG. 1. The database generation unit 30 may be based on a suitable workstation such as a Silicon Graphics VGX workstation.

The off-line audio and visual database generation unit 30 illustrated in FIG. 3 preferably includes the following units:

A CD-ROM player 80 operative to receive CD-ROM sound effect libraries storing a variety of sound effects. A suitable sound effect library is marketed by Valentino Production Music and Sound Effects Library, Elmsford, N.Y., USA;

A video grabbing tool 82, such as Silicon Graphics's Video Framer, operative to grab, digitize and store video frames from a VCR;

A high resolution image scanner 84 such as a UC-1260 scanner, commercially available from UMAX Data Systems, Inc., Hsinchu, Taiwan, which is operative to scan in still images;

Digital sound editing tools 86 operative to edit sound effects acquired from CD-ROM player 80;

Image paint and animation tool 88, such as the Parallax Matador Paint-and-Animation tool, operative to semi-automatically manipulate the images received from the scanner 84 or the video grabbing tool 82;

File format conversion tools 90 operative to convert sound and images produced by sound editing tools 86 and paint and animation tool 88, respectively, into a format used by the sound generator and image generator of FIG. 2; and High capacity disks 92 preferably operative to store several gigabytes of data including unprocessed video sequences, sounds and stills and/or final products including processed one-frame and multiframe animation sequences and corresponding sound effects and high resolution background images.

Figure 4:
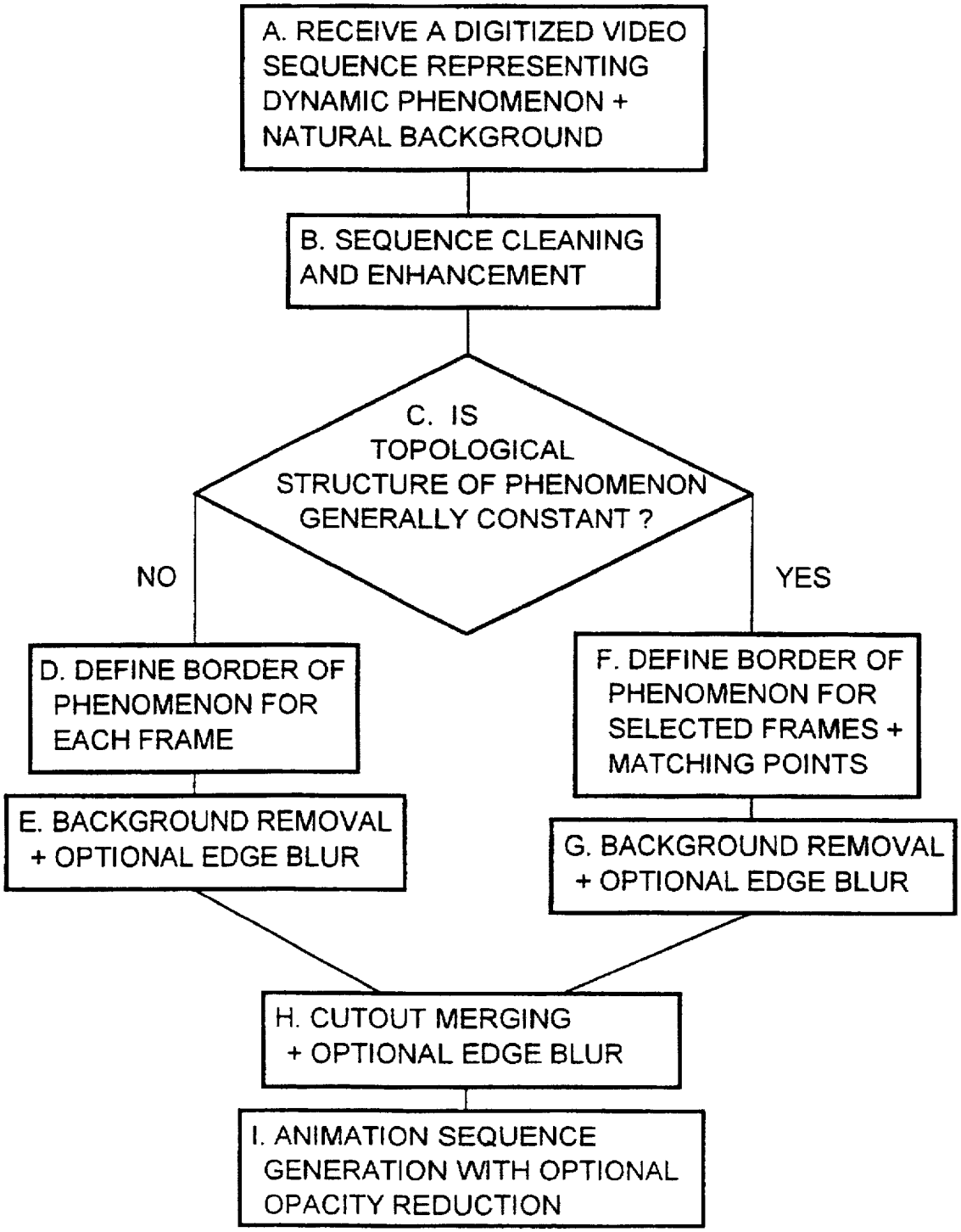
FIG. 4 is a simplified flowchart illustration of a method for merging a video image sequence of a dynamic phenomenon occurring on a natural background into a high resolution background image, using the image paint and animation tool 88 of FIG. 3.

FIG. 4 is a simplified flowchart illustration of a method for merging a video image sequence of a dynamic phenomenon occurring on a natural background into a high resolution background image.

The method preferably comprises the following processes:

A. Receiving a digitized video sequence representing a dynamic phenomenon photographed on a natural background. Preferably, each dynamic phenomenon is photographed on a plurality of natural backgrounds corresponding to a plurality of geographic locations and/or a plurality of weather conditions and each resulting video sequence is processed separately according to the method of FIG. 4.

B. Optionally, a human operator "cleans" the video sequence of irrelevant information and/or noise and/or enhances the phenomenon, e.g. by sharpening, histogram spreading, or other conventional methods. Preferably, the operator "cleans" and/or enhances only a few images, such as approximately 1 out of 50 images, within the sequence and the remaining images, e.g. the remaining 49 out of 50 images, are cleaned and/or enhanced automatically using conventional graphic image tools. For example, on the offline database generation station 30, the Macro option of the Matador Paint-and Animation tool may be employed to define a suitable macro for cleaning and/or enhancing a particular image and the same macro may then be activated on subsequent images.

C. Preferably, a determination is made as to whether the topological structure of the phenomenon is generally constant. If so, a process which requires less time and less operator involvement may be employed. The determination may be made by inspection of the video sequence of the phenomenon by the operator. For example, a physical phenomenon such as an explosion, fire, smoke or dust normally has a generally constant topological structure whereas human motion, e.g. the walking motion of an infantryman, lacks a constant topological structure. Alternatively, the determination may be made by image processing and suitable topological analysis.

D. If the topological structure is generally not constant, or if step C is omitted, then, for each image, the borders of the phenomenon are defined by a human operator, e.g. by drawing a spline curve around the phenomenon. For example, if the phenomenon is a walking infantryman, the human operator may draw a spline curve around the silhouette of the infantryman in each of the images. The Spline option of the Matador Paint-and Animation tool is suitable for this purpose.

E. The background of the phenomenon, i.e. the portion of each video image which is external to the border defined in step d, is removed, e.g. replaced by black. A macro may be defined within the Matador Paint-and Animation tool. The output of the macro comprises a sequence of "cut-outs" representing each of the images of the phenomenon, minus the background.

F. If the topological structure is generally constant, then a subset of images is selected, e.g. one image out of each subsequence of 10 or 20 images. For each selected image, the borders of the phenomenon are defined by a human operator, e.g. by drawing a spline curve around the phenomenon and defining at least one and preferably 5–20 pairs of matching points between each pair of consecutive splines. For example, if the phenomenon is an explosion represented in a 60-image sequence, the human operator may draw a spline curve around the borders of the explosion in each of 6 selected images and define 10 pairs of matching points between the first and second selected images, second and third selected images, and so on. The Spline option of the Matador Paint-and Animation tool is suitable for this purpose. The In-Between option of the Matador Paint-and Animation tool is then employed to define spline curves for each of the non-selected images.

G. The background of the phenomenon, i.e. the portion of each video image which is external to the border defined in step F, is removed, e.g. replaced by black. A macro may be defined within the Matador Paint-and Animation tool. The output of the macro comprises a sequence of "cut-outs" representing each of the images of the phenomenon, minus the background.

H. The cut-outs generated in steps E or G are merged with a digitized high resolution image representing the desired background. For example, the Matador Paint-and Animation tool may be employed.

The output of process H is a sequence of images comprising the phenomenon merged with the desired high resolution background.

The term "high resolution background" is here employed to refer to a background having at least 1280×1024 pixels within the field of view or at least 1024×768 pixels within the field of view.

Optionally, the edges of the dynamic phenomenon, such as smoke, dust and fire, may be blurred into the background in steps E, G and H.

Optionally, the dynamic phenomenon may terminate gradually by fading continuously into the background, particularly for smoke, dust and fire. To do this, the animation sequence generation step I may be performed with continuous and gradual reduction of the opacity of the phenomenon in the final frames until the phenomenon is completely transparent, i.e. disappears.

Figure 5:
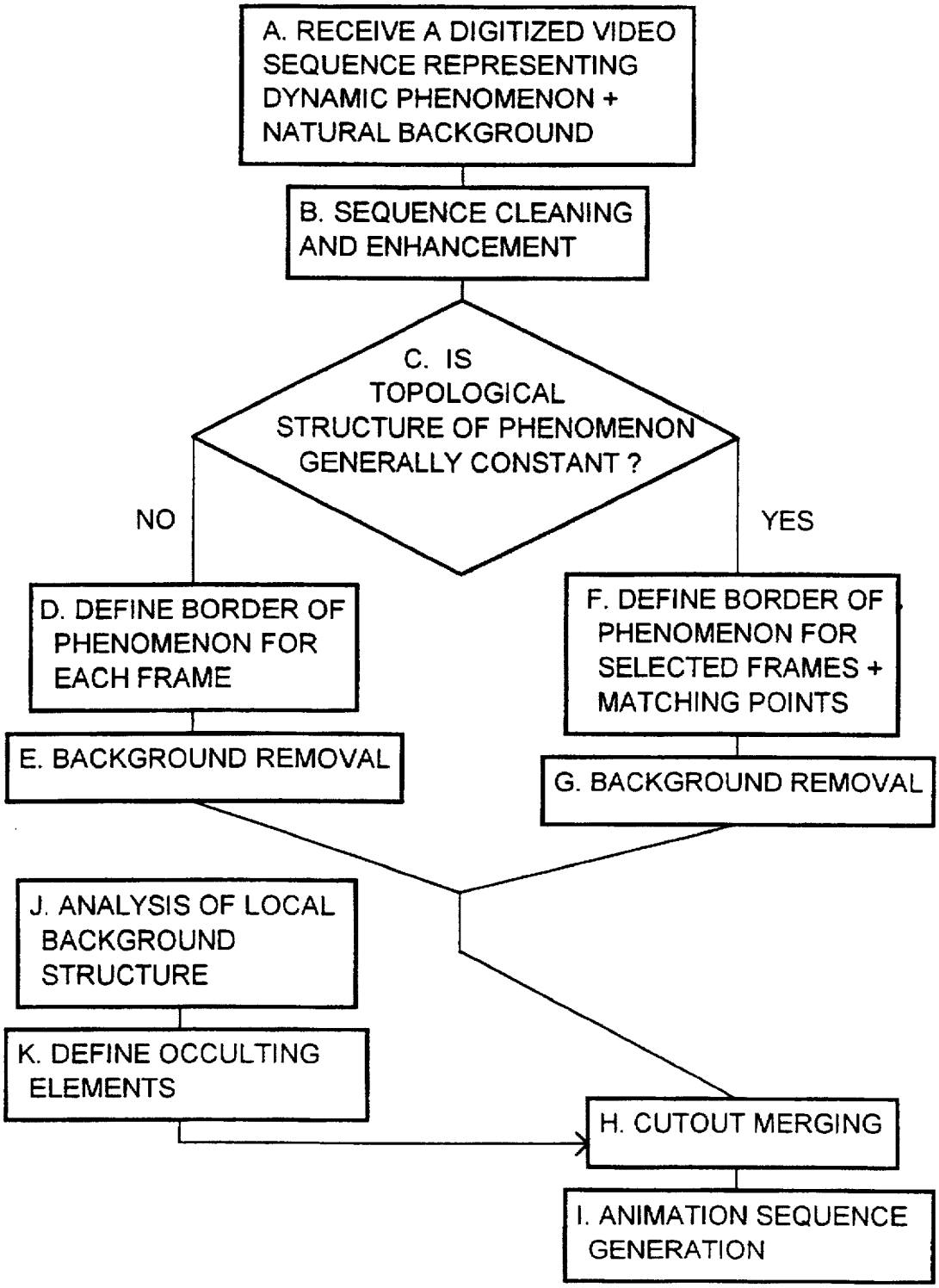
FIG. 5 is an enhancement of the method of FIG. 4 which is operative to analyze the structure of the desired background and to merge the phenomenon or other foreground video image sequence into the background such that appropriate occulting effects occur using the image paint and animation tool 88 of FIG. 3.

It is appreciated that both of the above options may also be effected in the method of FIG. 5.

Reference is now made to FIG. 5 which is an enhancement of the method of FIG. 4 which is operative to analyze the structure of the desired background and to merge the phenomenon or other foreground video image sequence into the background such that appropriate occulting effects occur.

The method of FIG. 4 is generally similar to the method of FIG. 5 except as follows. An additional process J is provided which may be performed off-line, in which the local structure of the background is analyzed in an area into which it is desired to merge a particular dynamic phenomenon or other foreground image sequence. Typically, a human operator may manually define one or more occulting elements within the background which are intended to occult the foreground image (step K). The occulting elements are typically all defined within a single mask, using the Mask option of the Matador Paint-and Animation tool and the mask is stored.

In the cutout merging step H, the mask is used to override those pixels of the foreground image sequence which overlap the occulting elements as the foreground image sequence is merged into the background. This generates an occulting effect in which the foreground image sequence occurs behind the occulting elements.

It is appreciated that the flowchart of FIG. 5 which relates generally to occulting effects for foreground images generally is also suitable for generating occulting effects for dynamic phenomena.

Figure 6:
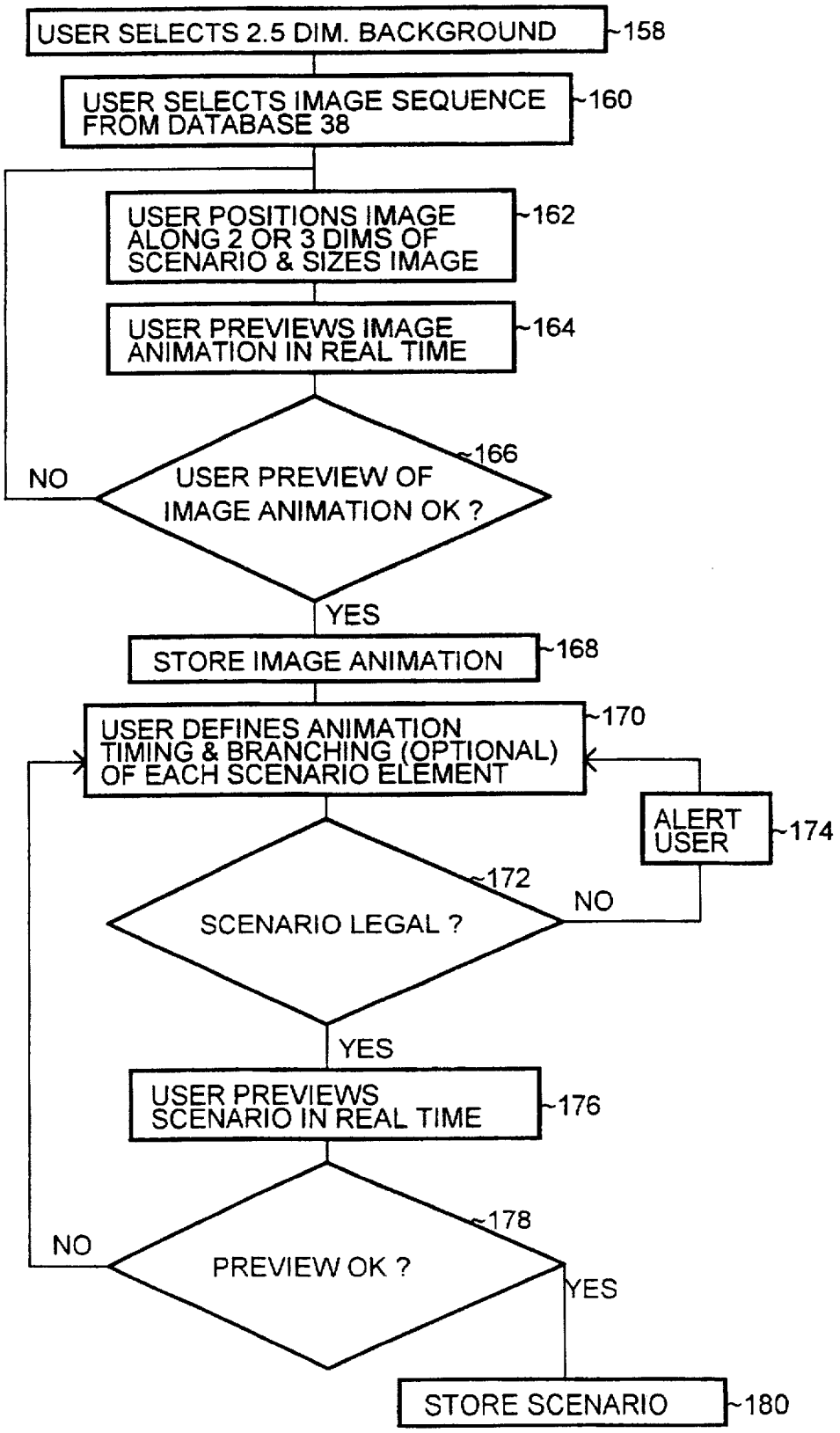
FIG. 6 is a simplified flowchart illustration of a very simple method for adding a video image sequence to a 2.5 dimensional scenario by an operator who is not trained in computer graphics, using the scenario generator 40 of FIG. 2.

Reference is now made to FIG. 6 which is a simplified flowchart illustration of a very simple method for adding a video image sequence to a 2.5 dimensional scenario by an operator who is not trained in computer graphics. The method of FIG. 6 may be carried out by the scenario generator 40 of FIG. 2 and preferably includes the following steps:

STEP 158—The user selects a 2.5 dimensional background from a plurality of scenarios which may, for example, be stored in scenario database 42 of FIG. 2.

Each 2.5 dimensional scenario may comprise a two-dimensional image of a scene including elements such as, say, two trees, three rocks and a backdrop of mountains. The scenario also includes an indication, for each of the elements, of its position along the Z axis, i.e. along the axis perpendicular to the plane of the two-dimensional image. Typically, the position indication comprises an ordering of the elements along the Z axis into "curtains", which may be predefined or may be defined or redefined by a user. Typically, the "curtains" define an order along the Z axis but the numerical differences between curtain values are not necessarily proportional to the distances between the curtains.

For example, the two trees and one of the rocks may be identified as being within a first curtain (curtain value=1), the remaining two rocks may be identified as being within second and fourth curtains, respectively, and the mountain backdrop may be identified as being within a sixth curtain. This information means that if an element is inserted and is identified as belonging to a third curtain (i.e., the element is identified as falling between the second and fourth curtains), this element will, if it overlaps elements from the first and second curtains, be occulted by those elements. On the other hand, if it overlaps elements from the fourth curtain onward, it will occult those elements. If a user requests that an element, identified as belonging to the third curtain, overlap another element in the third curtain, this request will be identified as illegal.

STEP 160—The user selects an image sequence, such as a left-facing running infantryman, from database 38 of FIG. 2.

STEP 162—The user positions the image, preferably by determining initial and final locations for the image within the selected two dimensional image, determining the image's size at each of the initial and final locations, and determining the "curtain" to which the image belongs at least at its initial location and its final location.

STEP 164—The user previews the image animation in real time. To provide this, the system merges the selected image sequence into the selected scenario such that the image moves from the selected initial location to the selected final location and such that its occulting relationship with other elements in the scenario is as defined by the curtain to which the image belongs.

STEP 166—If the preview is unsatisfactory, or if the user wishes to select another image sequence, the user returns to step 162. If the preview is satisfactory, STEP 168—The animations are stored. A suitable set of parameters defining an animation, which is not intended to be limiting, is described below.

STEP 170—The user defines the timing of each animation, i.e. when the image is to begin moving and, preferably, how fast the image is to move along its trajectory until its final location is reached. The user also optionally defines branching information, including at least one branch component, as described in detail below.

STEP 172—The system checks if the scenario is legal. For example, it may be desired to define as illegal two animation image sequences which overlap. More generally, it may be desired to define as illegal scenarios which exceed the real time processing capabilities of image generator 37 of FIG. 2. If the scenario is illegal, STEP 174—The system alerts the user to the illegality of the system and returns the user to step 170.

STEP 176—If the scenario is legal, the scenario is displayed to the user in real time for preview.

STEP 178—If the preview is not satisfactory, the user returns to step 170. If the preview is satisfactory, STEP 180—the timing and branching information is stored. .

Figure 7:
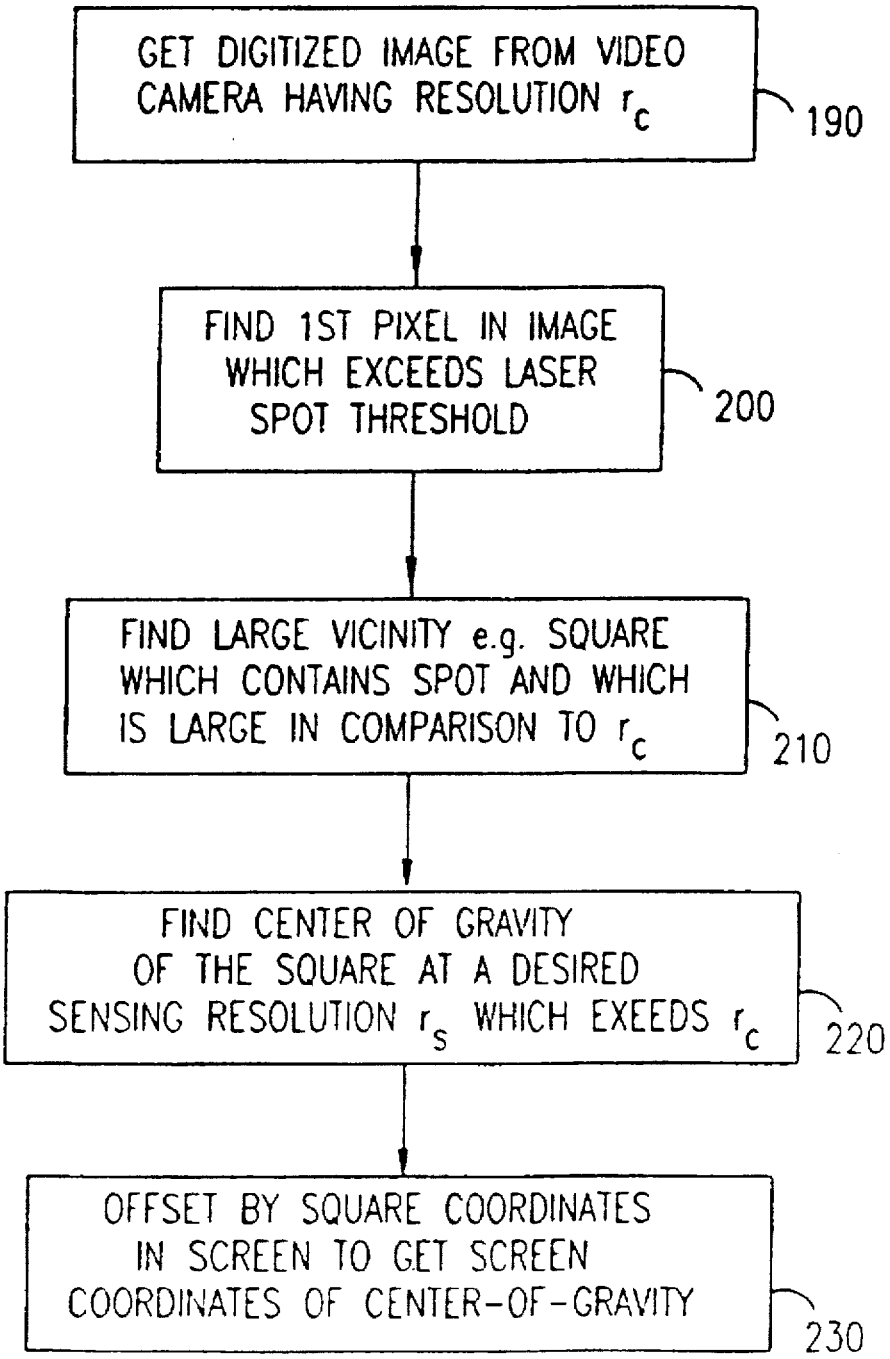
FIG. 7 is a simplified flowchart illustration of a preferred method, performed by position detection module 54 of FIG. 2, for sensing an indication, provided by the laser system of weapon station 10, of a location on the projection screen 15 of FIG. 1 at a first resolution, using the video camera 22 which has a second resolution which is less than the first resolution.

FIG. 7 is a simplified flowchart illustration of a preferred method for sensing an indication, provided by the laser system of weapon station 10, of a location on the projection screen 15 of FIG. 1 at a first resolution, using the video camera 22 which has a second resolution which is less than the first resolution. Generally, the method includes providing an indication of a vicinity of the location which is large in comparison to the second resolution, and processing the indication of the vicinity in order to find a central location therewithin at a resolution which is at least equal to said first resolution.

Specifically, a preferred method for sensing a location of, for example, a laser spot on a screen includes the following steps:

STEP 190—Get a digitized image of the screen from the video camera 22.

STEP 200—Find a pixel in the image which exceeds a predetermined threshold above which a pixel is considered to belong to a laser spot generated by the laser system. A suitable threshold value may be determined by generating a laser spot at a known location and determining the pixel size thereof.

STEP 210—Find a box which contains the spot. For example, if the laser spot is known to be 10 pixels in diameter, the box may be taken to be a square whose center is the pixel found in step 200 and whose sides are 10–15 pixels long. It is appreciated that the box need not necessarily be a square.

STEP 220—Find the center of gravity of the square, using the pixel values of the pixels within the square. The center of gravity may be found based on Formulae 12 and 13 which appear below. The parameters of Formulae 12 and 13 are as follows:

$X_c$, $Y_c$=coordinates within the square of the center of gravity of the square n, m=summation indices within the square f(n,m)=digitized image intensity at the pixel (n,m)

(▲x,▲y)=the spatial sampling accuracy of the camera along the horizontal and vertical dimensions, i.e. the horizontal and vertical dimensions of the area seen by a single camera pixel.

STEP 230—Compute the screen coordinates of the center of gravity by offsetting the coordinates within the square by the coordinates of the square within the screen.

A detailed discussion of Formulae 12 and 13 is as follows:

When a laser transmitter transmits perpendicularly to a large screen at a certain distance from the laser transmitter, generating a laser spot on the screen, the intensity function I(x,y) of the screen can be represented as a 2 dimensional process as described below in Formula 1. Formula 1 models a radial laser spot projection on a background screen with a constant background intensity C and Gaussian environmental noise n(x,y). The total laser beam power of the laser source is P; the laser spot radius, where intensity reaches the value of $1/e^2$ (practical zero) is W; and $(X_O, Y_O)$ are the coordinates of the laser spot center.

Formula 2 models the laser spot intensity function without noise and after normalization of the intensity level and generalizing to the case that the laser spot is elliptical in shape rather than necessarily radial. The a and b values are proportional to the radii of the elliptical laser spot.

The coordinates $(x_O, y_O)$ of the laser spot centerpoint may be found by averaging over x and y as in Formulas 3 and 4, thereby to obtain the center of gravity of the function f(x,y) in Formula 2.

A two-dimensional process is bandwidth limited if its Fourier transform F(u,v) is zero beyond a certain limit, which condition appears herein as Formula 5. In the present application, the 2D process is the digitized screen image generated by video camera 22 of FIG. 1.

According to the sample theory of a 2D process, a process can be reconstructed from its digitized samples if the process is sampled using a sampling resolution (▲x, ▲y) which complies with Nyquist's criterion which is set forth in Formula 6 below.

The Fourier transform of a 2D process is set forth in Formula 7. The 2-dimensional process is, practically speaking, band limited and the sampling frequency, i.e. the camera resolution, is predetermined. In order to meet the condition of Formula 6, the laser transmitter parameters must be set so as to enlarge the laser spot.

Formulas 8–10 compute the minimal spot size required to be able to reconstruct the 2D process, given a predetermined sampling resolution (▲x, ▲y) of a particular camera.

The sampled process is set forth in Formula 11, where n and m are indices of samples of the 2-dimensional digital process.

From the samples, the center of gravity may be estimated by averaging the digitized samples thereby to obtain the coordinates of the spot's center which are given in Formulas 12 and 13 below.

The Formulae used in the above discussion are as follows:

$$I(x,y) = C + n(x,y) + \frac{2 \cdot P}{\pi \cdot W^2} \cdot e^{-2((x-x_0)^2+(y-y_0)^2)/W^2} \quad [1]$$

$$f(x,y) = e^{-(x-x_0)^2/a^2} \cdot e^{-(y-y_0)^2/b^2} \quad [2]$$

$$x_0 = \frac{\iint x \cdot f(x,y) \cdot dxdy}{\iint f(x,y) \cdot dxdy} \quad [3]$$

$$y_0 = \frac{\iint y \cdot f(x,y) \cdot dxdy}{\iint f(x,y) \cdot dxdy} \quad [4]$$

-continued $$F(u,v)=\begin{cases} \neq 0 & u\in[-Umax,Umax] \\ & v\in[-Vmax,Vmax] \\ =0 & \text{else} \end{cases} \quad [5]$$

$$\begin{cases} \frac{1}{\Delta x} > 2Umax \\ \frac{1}{\Delta y} > 2Vmax \end{cases} \quad [6]$$

$$F(u,v)=ab\pi\cdot e^{-(au)^2/4}\cdot e^{-(bv)^2/4} \quad [7]$$

$$e^{-2}=e^{-(aU_{max})^2/4}\rightarrow U_{max}=\sqrt{8}\ /a \quad [8]$$

$$e^{-2}=e^{-(bV_{max})^2/4}\rightarrow V_{max}=\sqrt{8}\ /b \quad [9]$$

$$a>4\sqrt{2}\cdot\Delta x,\ b>4\sqrt{2}\cdot\Delta y \quad [10]$$

$$f(n,m)=e^{-(n\cdot\Delta x-x_0)^2/a^2}\cdot e^{-(m\cdot\Delta y-y_0)^2/b^2} \quad [11]$$

$$X_c=\frac{\Delta x\cdot\sum_{n,m} n\cdot f(n,m)}{\sum_{n,m} f(n,m)} \quad [12]$$

$$Y_c=\frac{\Delta y\cdot\sum_{n,m} m\cdot f(n,m)}{\sum_{n,m} f(n,m)} \quad [13]$$

Figure 8:
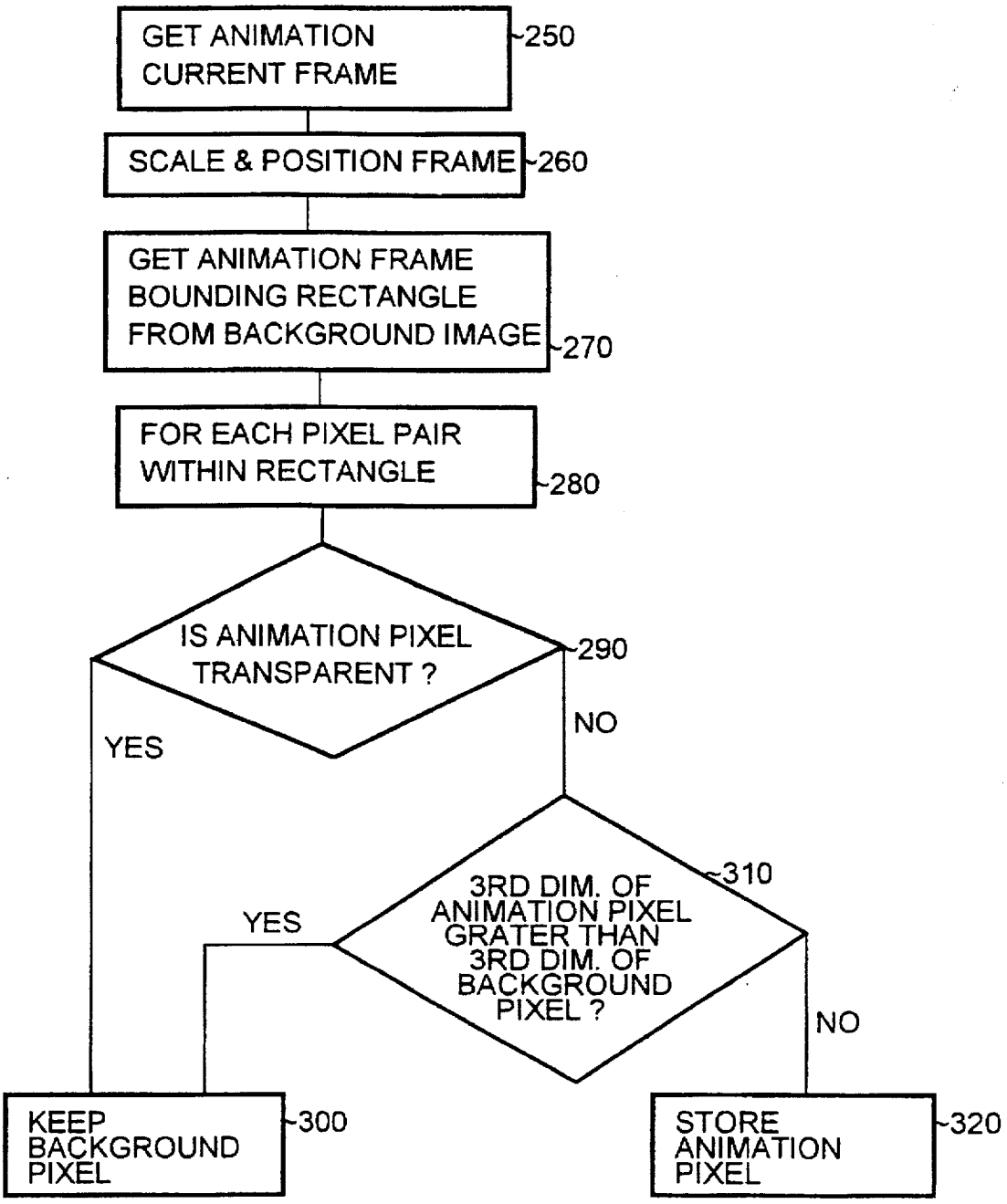
FIG. 8 is a simplified flowchart illustration of a preferred method, performed by image generator 37 of FIG. 2, for merging a video image sequence, frame by frame, into a high resolution background image in real time, e.g. at a display rate of at least 15 Hz.

FIG. 8 is a simplified flowchart illustration of a preferred method according to which the image generator 37 of FIG. 2 merges a current frame of an active animation image sequence into a high resolution background image in real time, e.g. at a display rate of at least 15 Hz. The method of FIG. 8 is repeated for each active animation appearing on an active animation list, as described in detail below, thereby to generate a single frame of a scenario.

The method of FIG. 8 preferably includes the following steps:

STEP 250: Get the current frame of the current active animation. Non-image pixels within the frame are transparent. Image pixels within the frame are opaque. For example, if the frame includes an image of an infantryman, the pixels within the infantryman image are opaque and all other pixels are transparent.

STEP 260: The scale and position of the current active animation frame is computed by interpolating between the scale and position of the previous path component and of the next path component, using relative weighting which is proportional to the relative separation between the current time and the time stamps of the previous and next path components.

STEP 270: Find, within the background image, a rectangle of the same size as the frame itself, within which the scaled and positioned current active animation frame will reside. Each animation frame pixel corresponds to a pixel within the background rectangle, thereby to define a plurality of pixel pairs corresponding in number to the number of pixels in each frame.

STEP 280: Perform steps 290–320 for each pixel pair:

STEP 290: Is the current animation pixel transparent? If so:

STEP 300: Keep the background pixel.

STEP 310: If the current animation pixel is opaque, determine whether the image occults the background (third dimension value of animation pixel is less than or equal to third dimension value of background pixel) or is occulted by the background (third dimension value of animation pixel exceeds the third dimension value of background pixel).

STEP 320: In the first instance, override the background pixel value with the animation pixel value.

In the second instance (step 300), retain the background pixel value.

Figure 9:
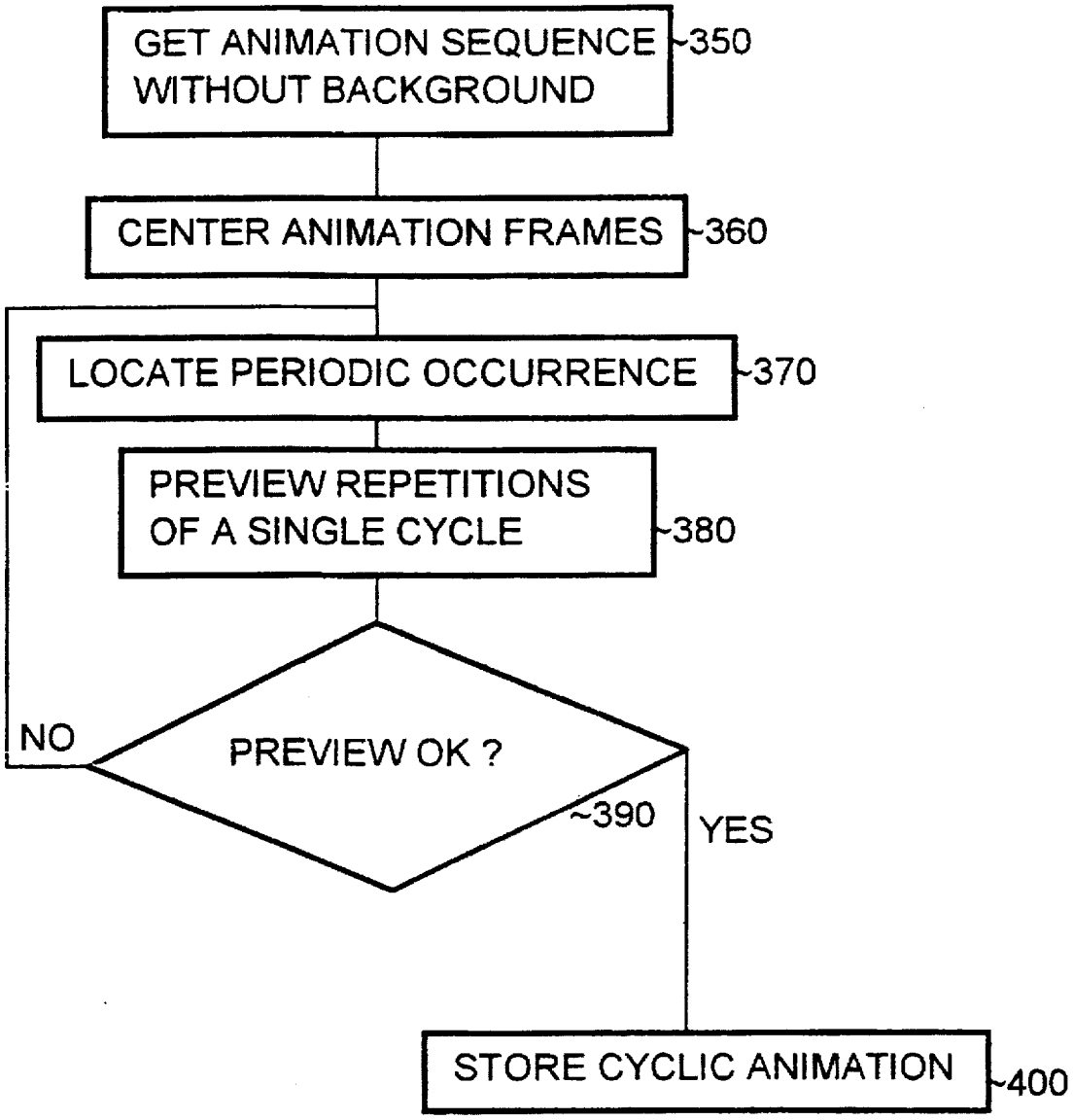
FIG. 9 is a simplified flowchart illustration of a preferred method for generating a cyclic animation sequence from a larger animation sequence, using the image paint and animation tool 88 of FIG. 3.

Preferably, as shown in FIG. 9, the video image sequence is modified before being merged into the background such that its final images are similar to its initial images. To do this, a video image sequence is provided (step 350) whose background has been removed as described above with reference to FIG. 4. The foreground figure is centered in each frame (step 360) such that the foreground figure is similarly positioned in all frames. The centered video image sequence is then examined, typically by a human operator, to identify subsequences therewithin having periodic recurrence, in which the final image is similar to the initial image, preferably such that the final images lead smoothly into the initial images (step 370).

Typically, a suitable subsequence answering to this criterion is identified by previewing a candidate subsequence repeated a plurality of times (step 380). If the resulting video sequence does not appear smooth (step 390), a different candidate subsequence is examined in the same way. If the sequence does appear smooth, the sequence is stored (step 400).

The cyclic video image sequence comprises the selected subsequence,. repeated a plurality of times by the image generator 37 of FIG. 2. The cyclic video image sequence is typically stored in the sounds and images database 38 of FIG. 2.

Figure 10:
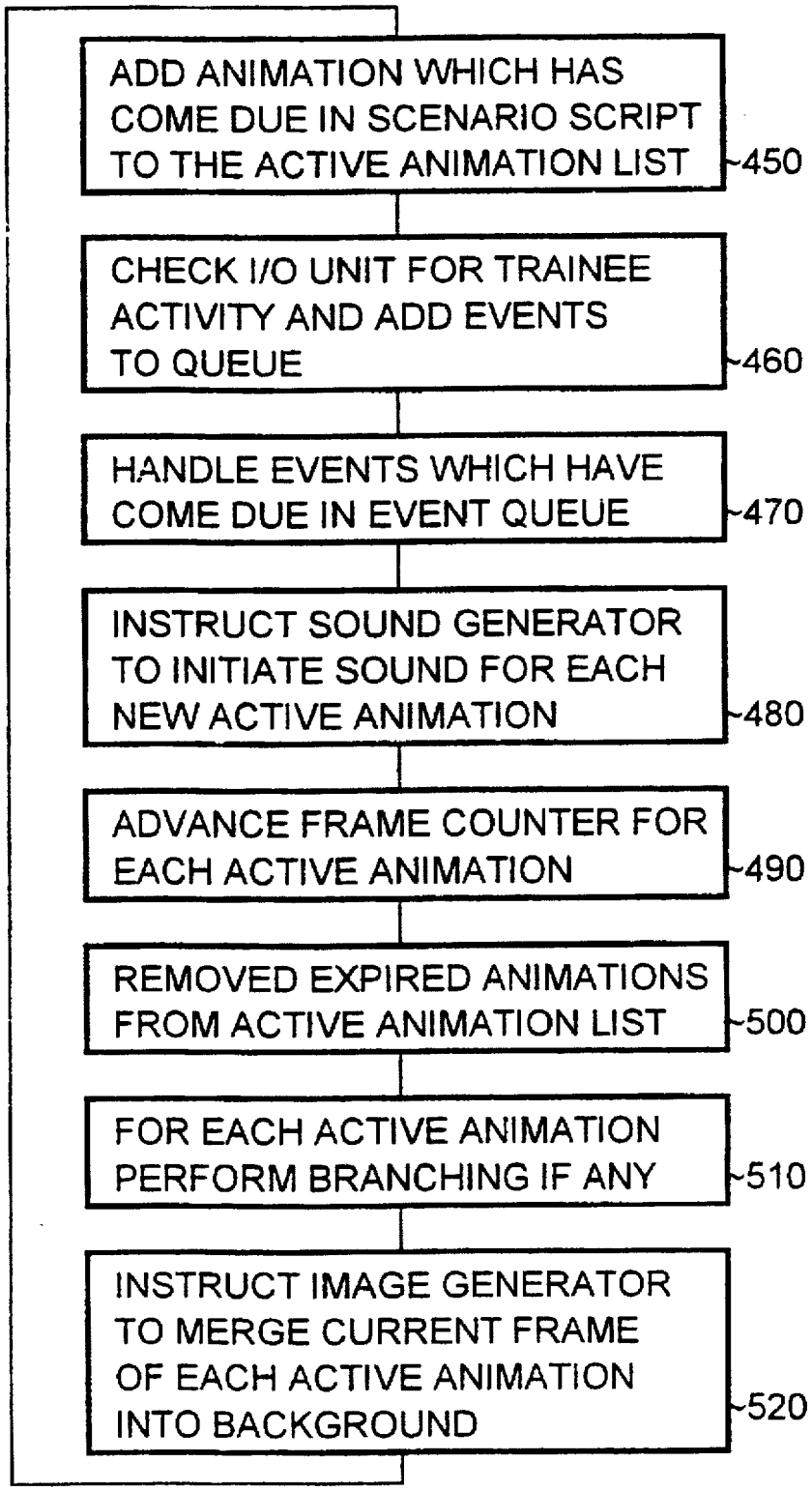
FIG. 10 is a simplified flowchart illustration of a preferred method, performed by scenario manager 32 of FIG. 2, for playing a scenario which may, for example, have been defined by a user using the method of FIG. 6.

FIG. 10 is a simplified flowchart illustration of a preferred method for playing a scenario for which a script may, for example, have been defined by a user using the method of FIG. 6. Scenario scripts are typically stored in scenario database 42 of FIG. 2. The method of FIG. 10 may, for example, be carried out by the scenario management unit 32 of FIG. 2.

Typically, each scenario script stored in scenario database 42 of FIG. 2 comprises the following information:

a. A reference to a high resolution image of the scenario's background, which image is typically stored in sound and images database 38 of FIG. 2.

b. At least one animation to be merged with the background image. Each animation includes:

i. a reference to an animation image sequence such as a sequence of frames representing a running infantryman or a single frame representing a tank. The animation image sequence itself is typically stored in sound and images database 38 of FIG. 2.

ii. optionally, a reference to a sound track, the sound track itself being stored in sound and images database 38 of FIG. 2.

iii. An animation path. Each animation path includes one or more path components. Each path component includes the following information:

a time stamp including the time within the animation path which the path component describes.

2 or 3 coordinates indicating the animation image sequence's position within the scenario along 2 or 3 dimensions, and the size of the animation image sequence.

For example, an animation path for a tank animation sequence may include two path components, corresponding to initial and final positions of a tank, wherein the first initial position is "close" and the second initial position is "far". In this case, the size of the animation image sequence at the initial, "close" position should be larger than the animation image sequence at the final "far" position. The size of the animation sequence between path components is varied gradually to achieve a smooth transition to the initial size and the final size.

Alternatively, if the system is fully three dimensional and if each path component includes 3-dimensional position data, the size of the animation image sequence may be user-determined for only one path component, and the size for all remaining path components may be computed automatically by the system depending on position along the third dimension, i.e. the dimension perpendicular to the screen on which the scenario is displayed.

iv. Optional branching information comprising at least one branch component. Each branch component typically includes the following information:

time stamp including the time interval within the animation path to which the branch component relates.

condition: The trainee activity which triggers the branch.

image sequence. The image sequence may be different for different time intervals within the animation path. For example, a left side view, front view and right side view of an infantryman image sequence may be used in different time intervals within the same animation path.

path component defining the final position of the image sequence. The path component includes the information described in the above discussion of the term "path component".

Periodically, preferably at display rate, e.g. 15 Hz, the following sequence of operations is performed repeatedly. Typically, the system returns to step 450 as soon as step 520 is completed. Therefore, for example, branching computations (step 510) are performed at display rate such that branching of the scenario appears to occur as an instantaneous result of user input.

It is appreciated that the order of steps in FIG. 10 may be changed in any suitable manner.

The method of FIG. 10 employs an active animation list which includes all active animations, i.e. animations which are currently on the screen or which are in action although they are not on the screen due to occlusion, panning or other effects.

STEP 450: Add all animations which have come due in the scenario script to the active animation list.

STEP 460: Check the I/O unit 60 and the position detection module 54 of FIG. 2 for trainee activity. If trainee activity is found, check the weapon simulation logic stored in the weapon logic module 48 of FIG. 2 which stores event sequences, each including at least one timed event, which are to be activated responsive to various trainee activities. Retrieve the relevant event sequence, and store the events it includes in a timed event queue to be handled in step 470. For example, if the I/O unit 60 indicates that the trigger of a missile has been pulled, the following single-event event sequence may be stored: "after 1 sec, instruct scenario manager 32 to initiate an explosion animation."

STEP 470: Check the timed event queue and handle any events therein which have come due. For example, an event may comprise initiation of an animation. In this case, the animation is added to the active animation list. Another example is that an event may comprise a weapon check and conditional insertion of additional events into the event queue depending on the weapon simulation logic.

STEP 480: Instruct sound generator to initiate sound for each new active animation, e.g. for each animation which was activated in the present cycle of FIG. 10.

STEP 490: Advance frame counter for each active animation.

STEP 500: Remove expired animations, i.e. animations whose last frame was the current frame in the previous cycle of FIG. 10, from the active animation list.

STEP 510: For each active animation, perform branching if appropriate, as described in detail below with reference to FIG. 11.

STEP 520: Instruct image generator 37 of FIG. 2 to merge the current frame of each active animation into the background. A suitable method for performing this merging step is described above with reference to FIG. 8.

Figure 11:
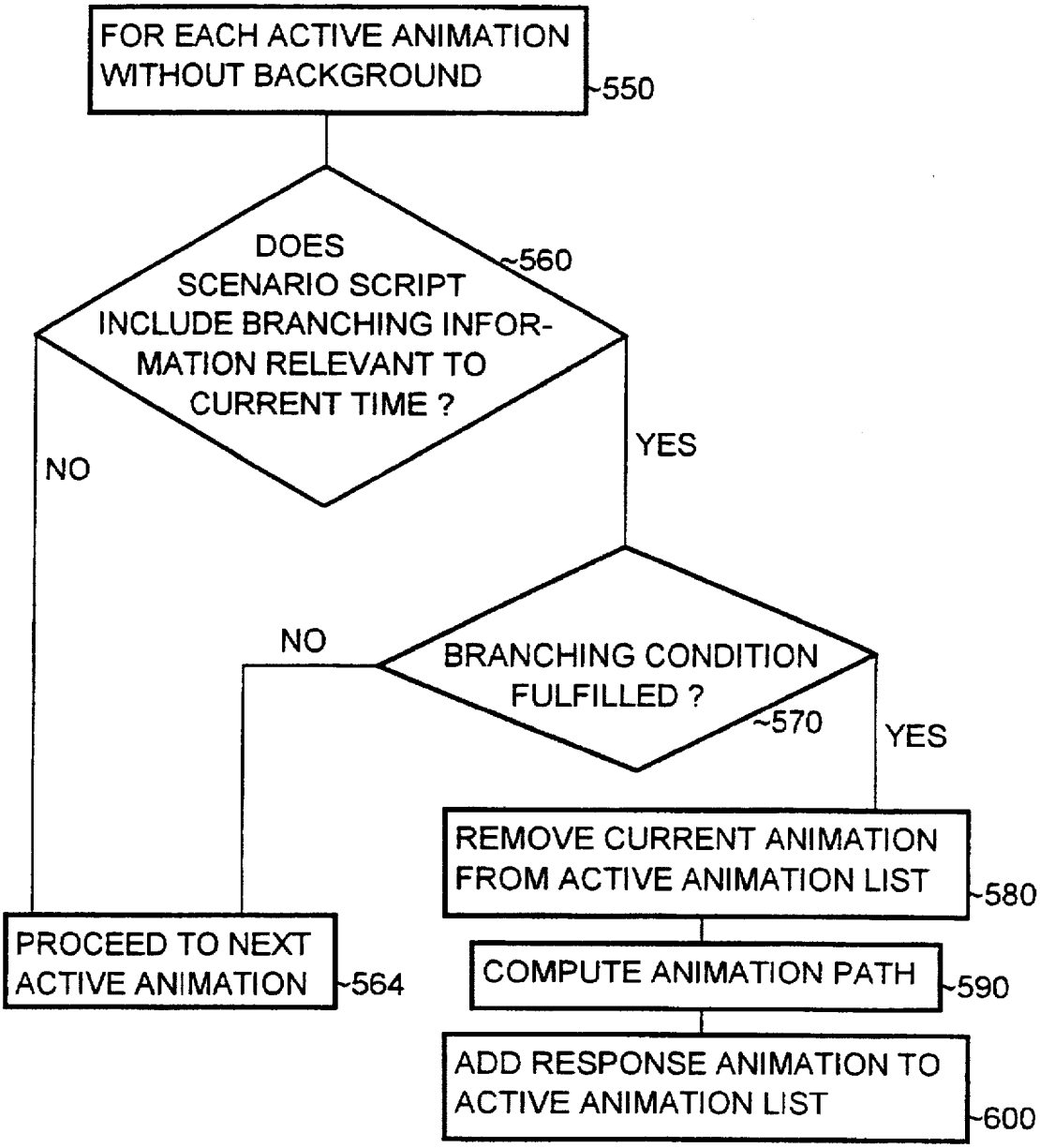
FIG. 11 is a simplified flowchart illustration of a preferred method for performing branching step 510 of FIG. 10.

Reference is now made to FIG. 11 which is a simplified flowchart illustration of a preferred method for performing branching.

STEP 550: For each active animation, perform steps 560 to 600.

STEP 560: Check within the scenario script for branching information in the current active animation which has a branching component which is relevant to the current animation time. If none, jump to step 564, i.e. perform steps 560 to 600 for the next active animation.

STEP 570: If a relevant branching component is found in step 560, check data gathered in step 460 of the method of FIG. 10 to determine whether the branching condition is fulfilled. If not, jump to step 564, i.e. perform steps 560 to 600 for the next active animation.

STEP 580: If the branching condition of the branching component is fulfilled, remove the current animation from the active animation list.

STEP 590: Compute an animation path extending from the current position of the image in the removed active animation to the final position-defining path component which is part of the branching information, as described above.

STEP 600: Add a "response animation" to the active animation list which includes the following information:

a. the image sequence which is referenced in the branching component; and b. the path computed in step 590.

Typically, response animations do not themselves include branching information.

It is appreciated that the term background image, as used throughout the specification and claims, may refer to various types of images such as, for example, a captured natural background or an artificial image.

It is appreciated that the present invention may be used in various applications, including, for example, entertainment and military training applications.

It is appreciated that the software components of the present invention may, if desired, be implemented in ROM (read-only memory) form. The software components may, generally, be implemented in hardware, if desired, using conventional techniques.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

We claim:

1. Apparatus for sensing an indication of a location on a surface at a first resolution using a video camera with a second resolution which is less than said first resolution, the apparatus comprising:

a large vicinity generator operative to provide an indication of a vicinity of the location which is large in comparison to the second resolution; and a large vicinity processor operative to process the indication of the vicinity in order to find a central location therewithin at a resolution which is at least equal to said first resolution, thereby to sense an indication of the location on the surface at a resolution which is at least equal to the first resolution.

2. Apparatus according to claim 1 and also comprising a video camera operative to sense the vicinity.

3. Apparatus according to claim 1 and also comprising a laser source operative to provide a laser beam whose cross section is large in comparison to the second resolution.

4. Apparatus according to claim 3 wherein said laser source is actuated by a model weapon.

5. A method for sensing an indication of location on a surface at a first resolution using a video camera with a second resolution which is less than said first resolution, the method comprising:

providing an indication of a vicinity of the location which is large in comparison to the second resolution; and processing the indication of the vicinity in order to find a central location therewithin at a resolution which is at least equal to said first resolution, thereby to sense an indication of the location on the surface at a resolution which is at least equal to the first resolution.

6. A method according to claim 5 wherein said location comprises an aiming location.

7. A method according to claim 6 wherein said aiming location comprises an aiming location of a simulated weapon.

* * * * *